US008143981B2

(12) United States Patent
Washizu et al.

(10) Patent No.: US 8,143,981 B2
(45) Date of Patent: Mar. 27, 2012

(54) INPUT DEVICE AND ELECTRONIC APPARATUS USING SAME

(75) Inventors: Tomoyuki Washizu, Moriyama (JP); Masahiro Abe, Ritto (JP); Takeshi Miyasaka, Moriyama (JP); Masayuki Murota, Ritto (JP)

(73) Assignee: OMRON Corporation, Kyoto (JP)

( * ) Notice: Subject to any disclaimer, the term of this patent is extended or adjusted under 35 U.S.C. 154(b) by 398 days.

(21) Appl. No.: 12/567,144

(22) Filed: Sep. 25, 2009

(65) Prior Publication Data

US 2010/0079225 A1 Apr. 1, 2010

(30) Foreign Application Priority Data

Sep. 26, 2008 (JP) ..... 2008-247358

(51) Int. Cl.
*H01H 9/00* (2006.01)

(52) U.S. Cl. ..... 335/205

(58) Field of Classification Search ..... 335/205
See application file for complete search history.

(56) References Cited

U.S. PATENT DOCUMENTS

| | | | | |
|---|---|---|---|---|
| 4,459,578 | A * | 7/1984 | Sava et al. | 338/128 |
| 5,504,502 | A * | 4/1996 | Arita et al. | 345/160 |
| 5,714,980 | A * | 2/1998 | Niino | 345/160 |
| 5,977,888 | A * | 11/1999 | Fujita et al. | 341/34 |
| 6,612,404 | B2 * | 9/2003 | Sweet et al. | 187/395 |
| 6,670,946 | B2 * | 12/2003 | Endo et al. | 345/160 |
| 6,707,446 | B2 * | 3/2004 | Nakamura et al. | 345/160 |
| 6,812,435 | B2 * | 11/2004 | Schilling | 219/457.1 |
| 6,909,353 | B2 * | 6/2005 | Romero Herrera et al. | 338/32 H |
| 7,151,526 | B2 * | 12/2006 | Endo | 345/156 |
| 7,417,422 | B2 * | 8/2008 | Kang | 324/207.25 |
| 7,468,603 | B2 * | 12/2008 | Kang et al. | 324/207.25 |
| 7,602,268 | B2 * | 10/2009 | Miyasaka et al. | 335/205 |
| 8,054,291 | B2 * | 11/2011 | Takatsuka | 345/157 |
| 2005/0068135 | A1 * | 3/2005 | Nishino et al. | 335/207 |
| 2006/0050053 | A1 | 3/2006 | Takatsuka | |

FOREIGN PATENT DOCUMENTS

| | | | |
|---|---|---|---|
| JP | 2002-062985 | A | 2/2002 |
| KR | 2007-0094022 | A | 9/2007 |

OTHER PUBLICATIONS

Office Action in Korean Patent Application No. 10-2009-0087015, Issued Jan. 27, 2011 (11 Pages With Translation).

* cited by examiner

*Primary Examiner* — Elvin G Enad
*Assistant Examiner* — Alexander Talpalatskiy
(74) *Attorney, Agent, or Firm* — Osha • Liang LLP

(57) ABSTRACT

An input device has a housing having an operation hole formed therein, an operation member supported in a slidably moving manner in multi-directions within the operation hole, and at least two magnetic sensors, arranged at a periphery of the operation member, for detecting change in magnetic property by displacement of the operation member. The operation member includes a holder having a circular ring-shaped magnet incorporated in a fit-in hole and a central push button having a disc plate made of magnetic material integrated at a lower surface. The central push button is fitted in the circular ring-shaped magnet to adsorb, in a separable manner, the disc plate to the circular ring-shaped magnet and position-regulate the central push button.

20 Claims, 10 Drawing Sheets

INPUT DEVICE AND ELECTRONIC APPARATUS USING SAME

BACKGROUND OF THE INVENTION

1. Technical Field

The present invention relates to an input device used in an electronic device such as a portable telephone, PC, PDA, television, and videocassette recorder.

2. Related Art

Conventionally, the input device includes a multi-direction input device including an operation member held in a slidable manner in multi-directions, a plurality of movable contacts having conductivity arranged at an outer peripheral part of the operation member, and a plurality of insulating substrates, including a resistor body, arranged in a range of the operation member, where each of the plurality of movable contacts is arranged facing the plurality of resistor bodies, and the movable contact moves with the slidable movement of the operation member so that the contact area of the movable contact with respect to the resistor body varies.

In such multi-direction input device, as shown in FIG. 1 of Japanese Unexamined Patent Publication No. 2002-62985, a collar part 11b of an operation body 11 projecting out from a hole 10d of a drive body 10 is prevented from slipping out in a hole 10c of the drive body 10.

SUMMARY

However, in the above-described multi-direction input device, the collar part 11b of the operation body 11 needs to be incorporated in the hole 10c of the drive body 10, and the operation body 11 needs to be slidably moved to operate. Thus, a gap in a vertical direction and a horizontal direction constantly is formed between the collar part 11b and the hole 10c. As a result, not only is thinning and miniaturization of the input device limited, but tilt and rattling occur in the operation body 11, and an abnormal noise caused by external vibration etc. tends to easily occur.

If the gap in the vertical direction is too small, the operation body 11 is pressed against the drive body 10 in a deformation that occurs when an external force is applied to a housing 12, and malfunction may occur. If the height dimension of the hole 10d of the drive body 10 and the thickness dimension of the collar part 11b of the operation body 11 are increased to increase the opposing slidably moving area in order to reduce tilt and rattling of the operation body 11, thinning cannot be achieved, while wear tends to easily occur by the slidably moving operation in the vertical direction of the operation body 11, and therefore, the durability lowers.

One or more embodiments of the present invention provides a thin and miniaturized input device capable of preventing tilt and rattling of the operation member and preventing occurrence of abnormal noise by position-regulating the operation member using magnetic force of a magnet necessary for the input operation, and an electronic device using the same.

In accordance with one aspect of the present invention, an input device includes an operation member supported in a slidably moving manner in multi-directions within an operation hole formed in a housing, and at least two magnetic sensors, arranged at a periphery of the operation member, for detecting change in magnetic property by displacement of the operation member, wherein the operation member includes a holder having a circular ring-shaped magnet incorporated in a fit-in hole and a central push button having a disc plate made of magnetic material integrated at a lower surface, the central push button being fitted in the circular ring-shaped magnet to adsorb, in a separable manner, the disc plate to the circular ring-shaped magnet and position-regulate the central push button.

According to one or more embodiments of the present invention, the disc plate of the central push button is adsorbed to the circular ring-shaped magnet of the holder and the central push button is position-regulated. Thus, tilt or rattling does not occur at the central push button, and generation of abnormal noise by external vibration and the like can be prevented.

Furthermore, a thin and miniaturized input device can be obtained since the gap between the holder and the central push button, in particular, the gap in the vertical direction becomes a minimum extent.

In another input device according to one or more embodiments of the present invention, the central push button and the disc plate may be integrally molded with same magnetic material.

According to one or more embodiments, the number of parts and the number of assembly steps are reduced, and the productivity is enhanced.

In accordance with one aspect of the present invention, an input device includes an operation member supported in a slidably moving manner in multi-directions within an operation hole formed in a housing, and at least two magnetic sensors, arranged at a periphery of the operation member, for detecting change in magnetic property by displacement of the operation member, wherein the operation member includes a holder having a circular ring-shaped magnet incorporated in a fit-in hole and a central push button having a disc plate made of magnetic material integrated at a lower surface, the central push button and the disc plate being integrally molded with same magnet material and having same polarity as the circular ring-shaped magnet, and the central push button being fitted in the circular ring-shaped magnet to position-regulate the operation member by a repulsive force of the magnet.

According to one or more embodiments of the present invention, the central push button is position-regulated as the disc plate is repelled to the circular ring-shaped magnet. Thus, tilt and rattling do not occur at the central push button, and generation of abnormal noise by external vibration and the like can be prevented.

In accordance with one aspect of the present invention, an input device includes an operation member supported in a slidably moving manner in multi-directions within an operation hole of a cover plate configuring a housing, and at least two magnetic sensors, arranged at a periphery of the operation member, for detecting displacement of the operation member with change in magnetic property, wherein the operation member has a circular ring-shaped magnet of a separate body integrally formed at an outer peripheral surface of the central push button, the central push button being operably exposed from the operation hole of the cover plate made of magnetic material, and the circular ring-shaped magnet being adsorbed, in a separable manner, to an inner side of the cover plate.

According to one or more embodiments of the present invention, the circular ring-shaped magnet adsorbs to the inner side of the cover plate, and the central push button is position-regulated. Thus, tilt and rattling do not occur at the central push button, and generation of abnormal noise by external vibration and the like can be prevented.

Furthermore, a thin and miniaturized input device is obtained since the holder is unnecessary, the number of parts and number of assembly steps are reduced, the productivity is high, and the gap between the cover plate and the central push button, in particular, the gap in the vertical direction becomes a minimum extent.

According to one or more embodiments of the present invention, the central push button of the operation member may be integrally molded with a magnet material same as the circular ring—shaped magnet.

According to one or more embodiments, the number of parts and the number of assembly steps are reduced, and the productivity is enhanced.

According to one or more embodiments of the present invention, a central push button switch may be arranged at a portion positioned immediately below the central push button of a print substrate assembled in the housing so as to be positioned on a lower side of the operation member.

According to one or more embodiments, a compound operation can be performed with the central push button, and a user friendly input device is obtained.

According to an electronic device according to one or more embodiments of the invention, the operation member of the input device may be assembled to be operable from outside.

According to one or more embodiments of the present invention, an electronic device in which tilt and rattling do not occur at the central push button, and generation of abnormal noise by external vibration and the like does not occur is obtained.

A thinner and miniaturized electronic device is obtained by incorporating a thin and miniaturized input device.

DETAILED DESCRIPTION

Figure 1A:
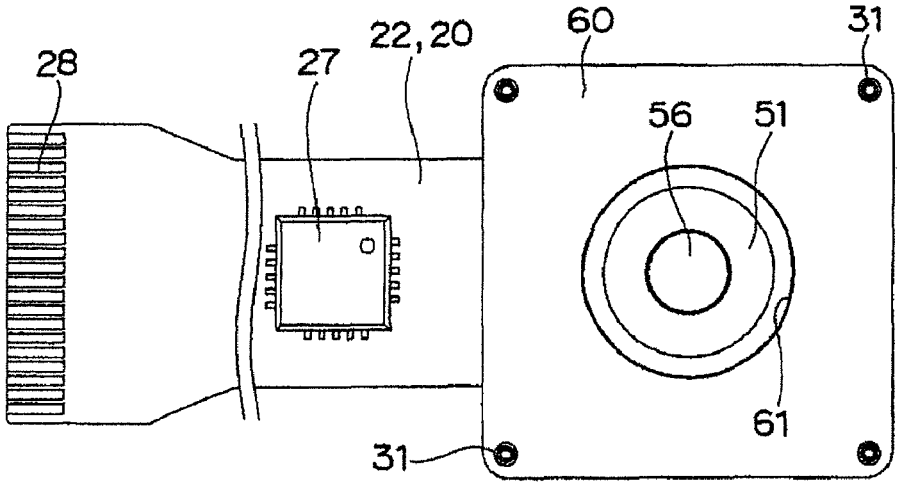
FIGS. 1A to 1C are a plan view, a front view, and a bottom view showing a an input device according to a first embodiment of the present invention.
Figure 1B:
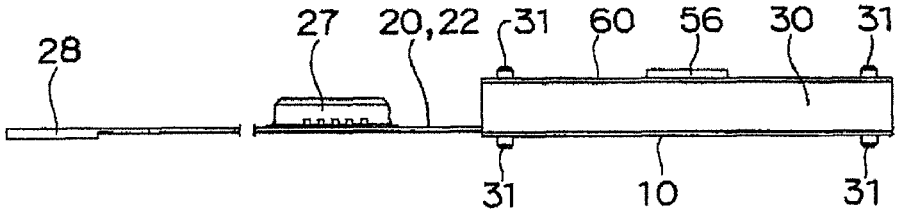
Figure 1C:
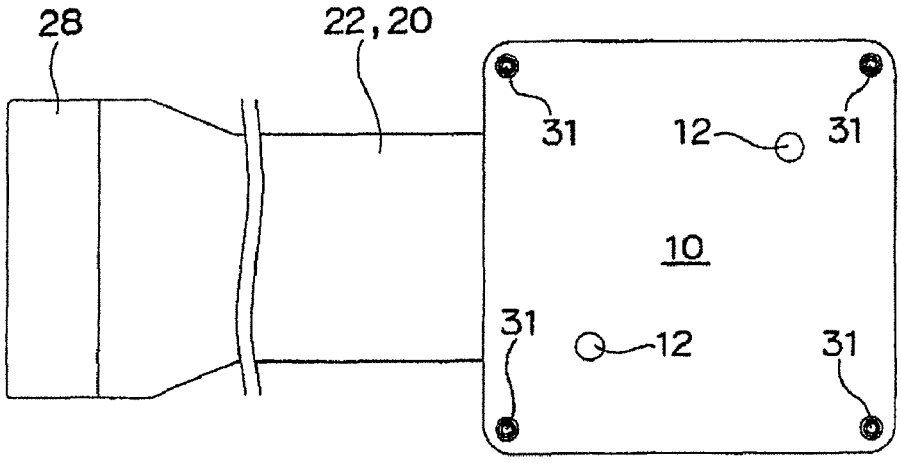
Figure 2A:
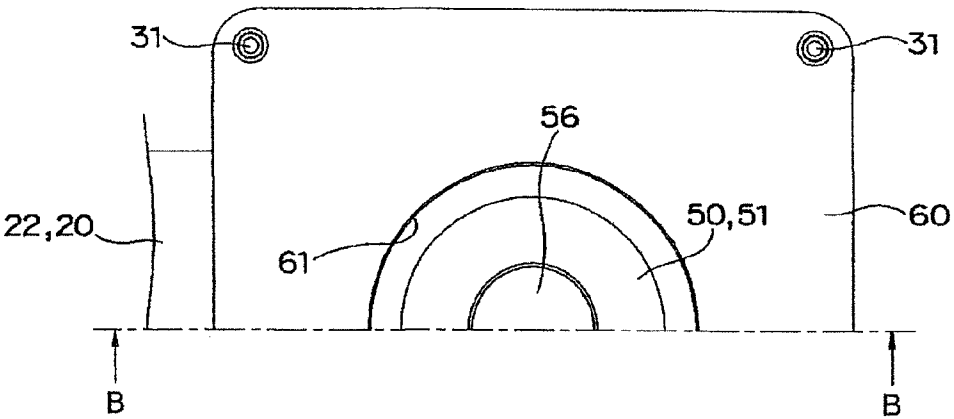
FIGS. 2A and 2B are a partially enlarged plan view and a cross-sectional view of the input device shown in FIGS. 1A to 1C.
Figure 2B:
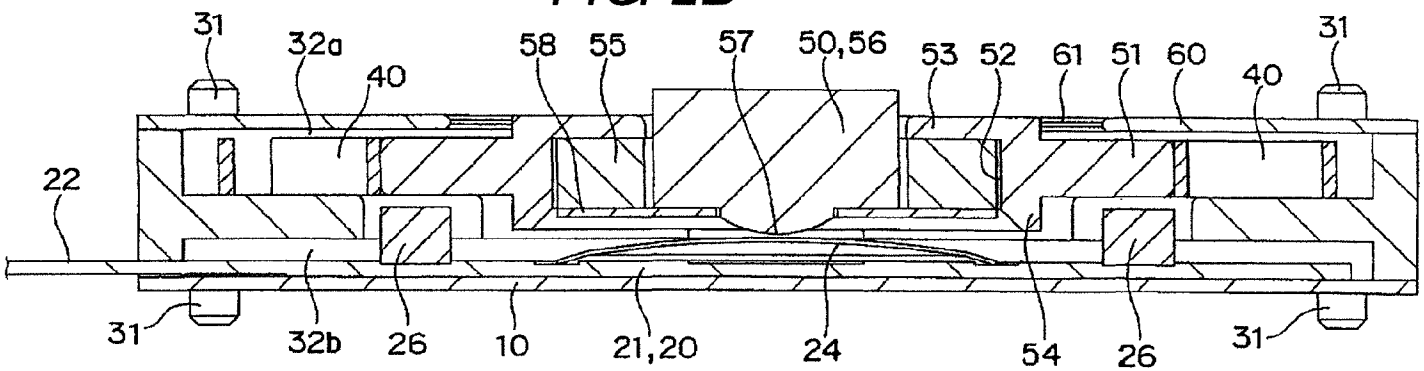

Hereinafter, preferred embodiments of the present invention will be described with reference to FIGS. 1A to 10C.

As shown in FIGS. 1A to 7C, the first embodiment includes a base plate 10, a flexible print substrate 20, a base 30, a position-regulation spring 40, an operation member 50, and a cover plate 60.

Figure 3:
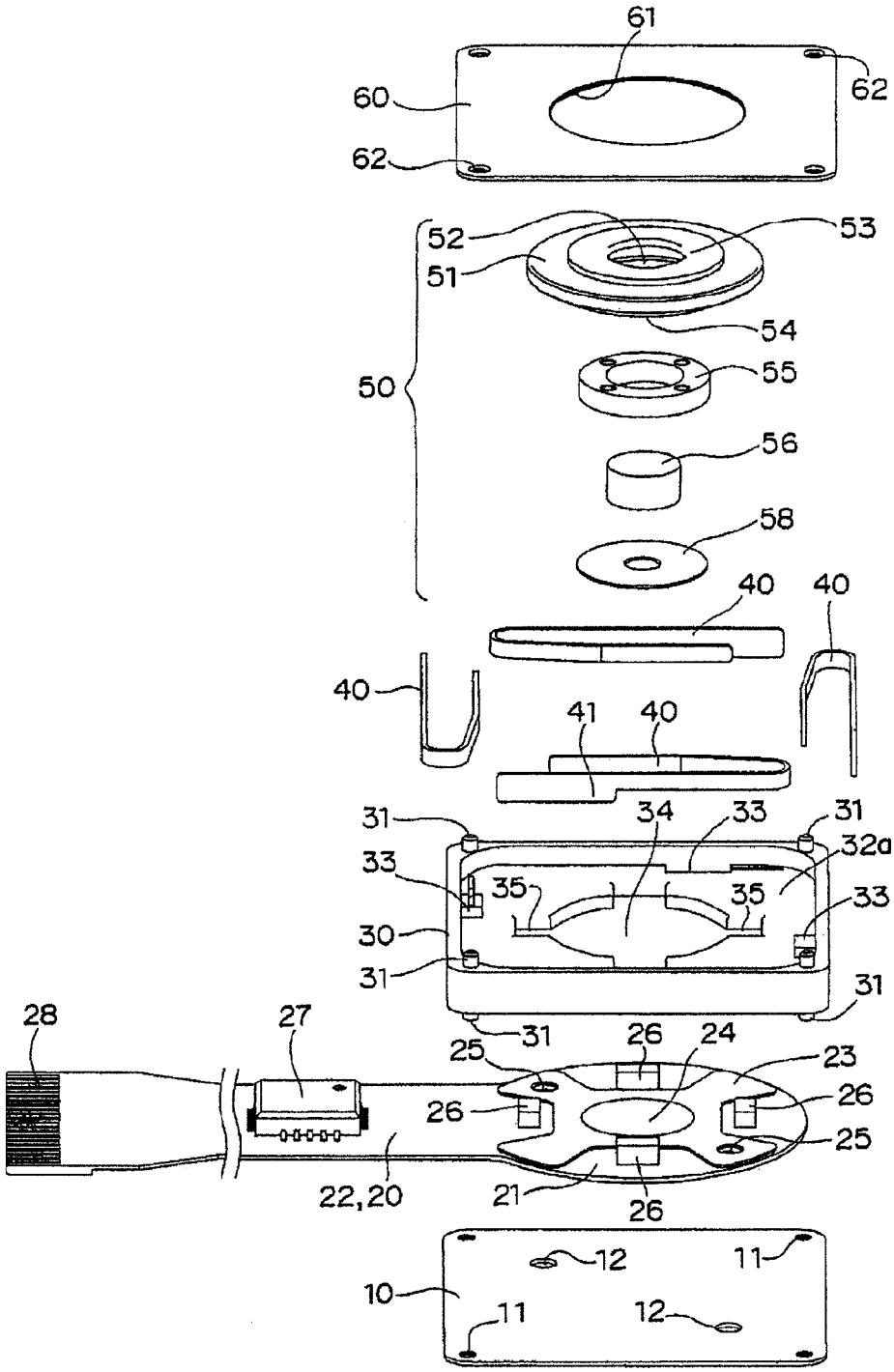
FIG. 3 is an exploded perspective view seen from the upper side of the input device shown in FIGS. 1A to 1C.
Figure 4:
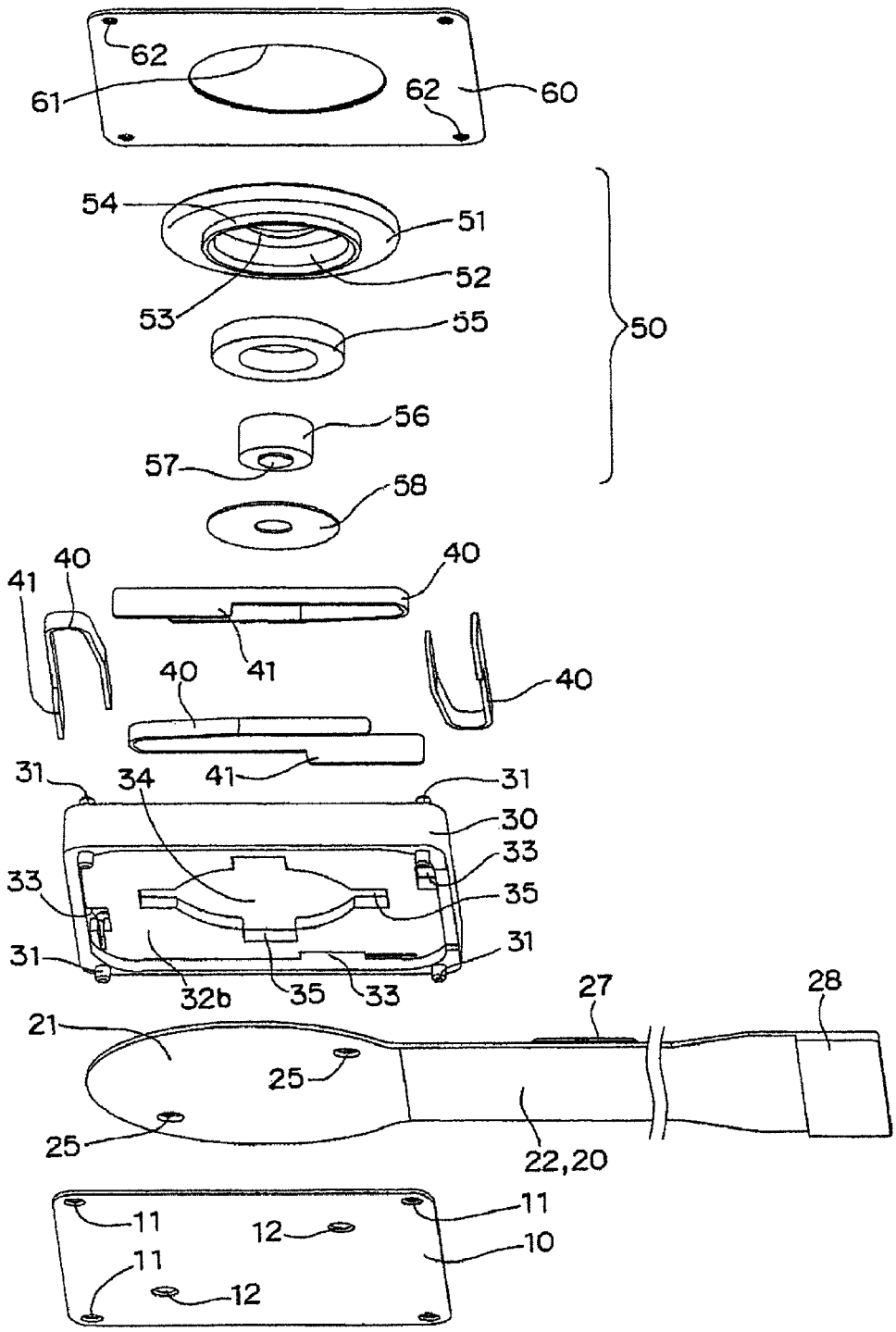
FIG. 4 is an exploded perspective view seen from the lower side of the input device shown in FIGS. 1A to 1C.

As shown in FIGS. 3 and 4, the base plate 10 is a metal thin plate having a substantially square shape in plane that includes a caulking hole 11 at the four corners and a jig hole 12 diagonally.

The flexible print substrate 20 has a lead portion 22 extending from a substantially circular print substrate main body 21 that can be mounted on the base plate 10. A dome sheet 23 having a substantially X-shape in plane is adhered and integrated to and with the print substrate main body 21, and a center push button switch 24 is formed at the central part and a jig hole 25 is formed. A Hall element 26 is mounted at the periphery of the dome sheet 23. A control IC 27 is mounted on the lead portion 22, and the lead portion 22 has a free end formed with a connecting portion 28.

Figure 5A:
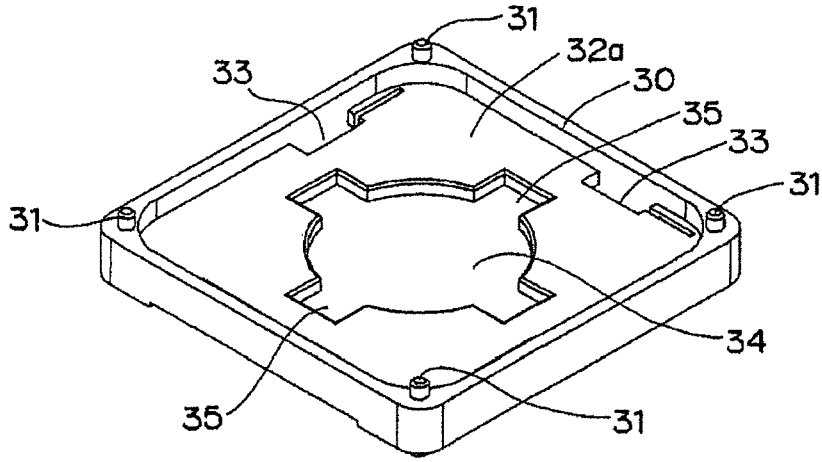
FIGS. 5A to 5C are a perspective view, a plan view, and a front view of the base shown in FIG. 3.
Figure 5B:
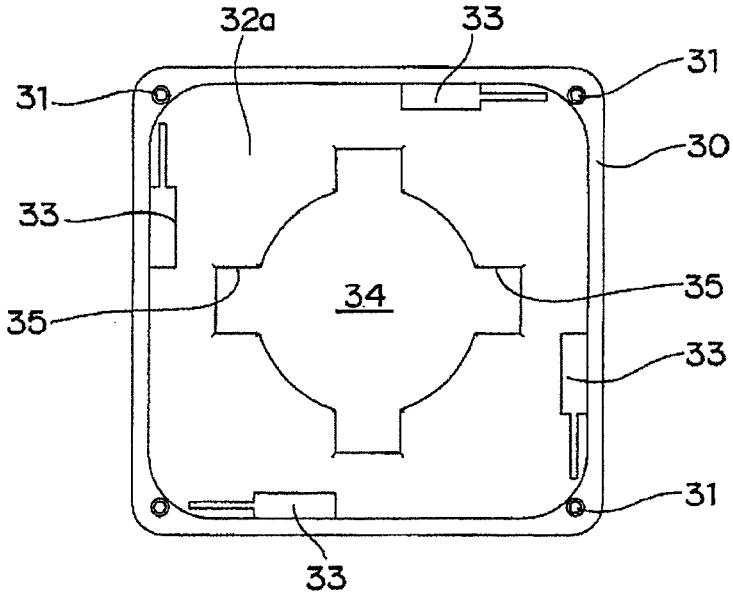
Figure 5C:
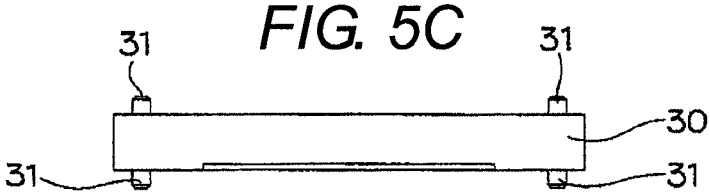

As shown in FIGS. 5A to 5C, the base 30 has a substantially H-shape in cross-section and has a square shape in plane so as to cover the base plate 10. The base 30 has a caulking projection 31 arranged in a projecting manner at four corners on the front and back surfaces, and a through groove 33 for engaging a return spring, to be hereinafter described, at the corner of recesses 32*a*, 32*b* formed on the front and back surfaces. A fit-in hole 34 for fitting an operation member 50, to be hereinafter described, is formed at the central part of the recesses 32*a*, 32*b*, and a cutout 35 for fitting to the Hall element 26 is formed at the outer peripheral edge of the fit-in hole 34.

Figure 6A:
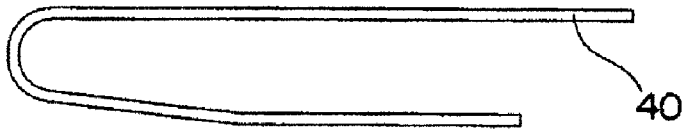
FIGS. 6A to 6C are a plan view, a front view, and a perspective view of a return spring shown in FIG. 3.
Figure 6B:
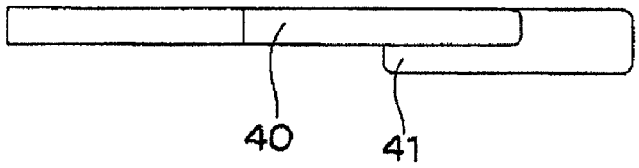
Figure 6C:
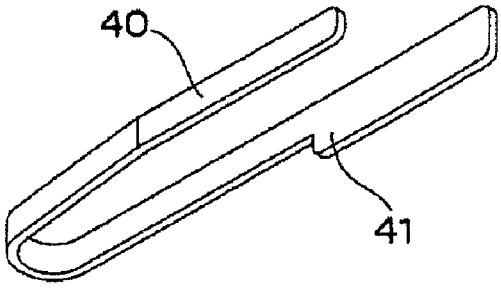
Figure 7A:
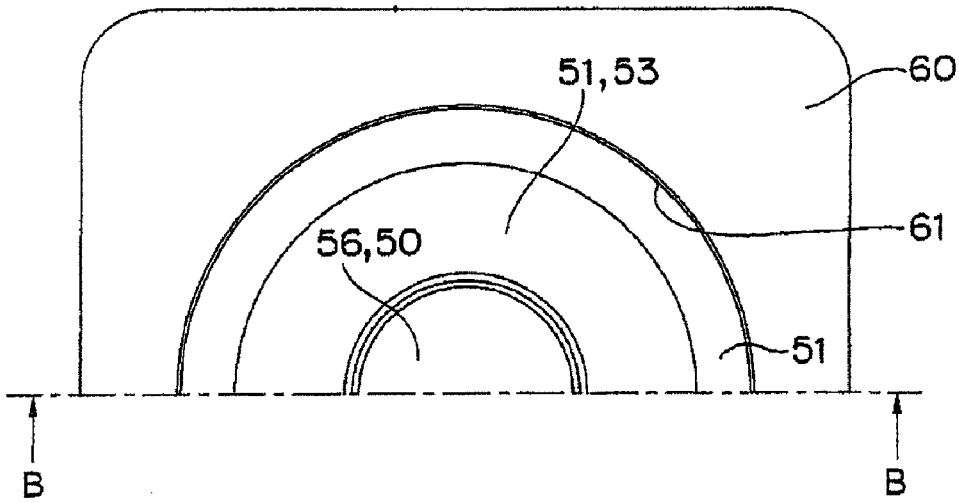
FIGS. 7A to 7C are a partial plan view, a cross-sectional view, and a partially enlarged cross-sectional view showing the input device shown in FIGS. 1A to 1C.
Figure 7B:
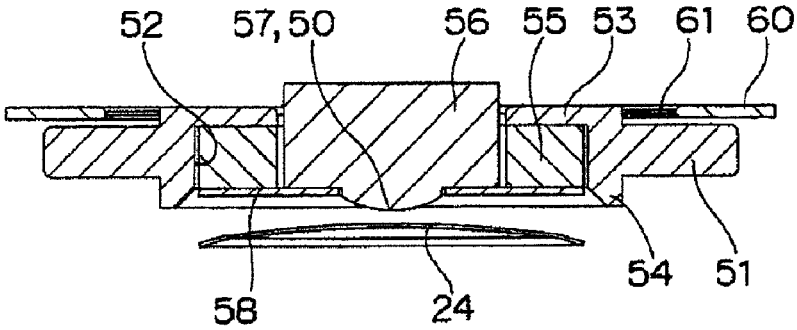
Figure 7C:
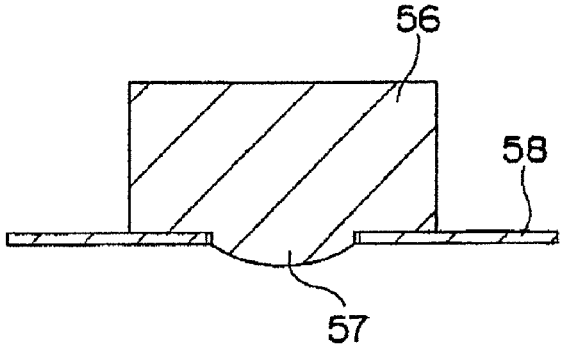

As shown in FIGS. 6A to 6C, the return spring 40 has a shape in which an elastic band-like material is bent to a substantially J-shape in plane, where an engagement projection 41 arranged in a projecting manner at one end is engaged to the through groove 33 of the base 30 to be positioned.

The operation member 50 includes a holder 51 assembled with a circular ring-shaped magnet 55, and a central push button 56 assembled with a disc plate 58.

The holder 51 has a disc shape with an outer diameter that can be arranged between the return spring 40 positioned in the base 30, where a collar part 53 is integrally molded at the edge of the upper surface of the fit-in hole 52 formed at its center and an annular rib 54 is arranged in a projecting manner at the edge of the lower surface. The circular ring-shaped magnet 55 is fitted and integrated to and with the fit-in hole 52. The circular ring-shaped magnet is arranged with the N pole and the S pole to the inside and outside, up and down, or front and back alternately.

The central push button 56 has a circular column shape having an outer diameter that can be fitted in the circular ring-shaped magnet, and includes an operation projection 57 on the bottom surface. The operation projection 57 is fitted and integrated to and with a concentric disc plate 58 made of magnetic material. Thus, when the central push button 56 is assembled in the circular ring-shaped magnet 55, the disc plate 58 is adsorbed and integrated in a separable manner to and with the circular ring-shaped magnet 55 to thereby position-regulate the central push button 56.

The cover plate 60 is a metal thin plate having a substantially square shape in plane that can cover the base 30, and includes an operation hole 61 of a diameter that can prevent the operation member 50 from slipping out at the middle, and a caulking hole 62 at four corners.

The assembly method of the input device made of the above-described configuring parts will now be described.

First, a pair of positioning pins, or a jig (not shown), is inserted and positioned in the jig hole 12 of the base plate 10. The Hall element 26 etc. is then mounted, and the jig hole 25 of the flexible print substrate 20 applied with an adhesive material on the back surface is inserted to the positioning pin to be adhered and integrated to and with the base plate 10.

The caulking projection 31 of the base 30 is then fitted and caulking fixed to the caulking hole 11 of the base plate 10. The engagement projection 41 of the return spring 40 is then fitted and positioned in the through groove 33 of the base 30. Furthermore, the circular ring-shaped magnet 55 is fitted and integrated to and with the fit-in hole 52 of the holder 51, and the disc plate 58 is fitted and integrated to and with the operation projection 57 of the central push button 56. The disc plate 58 is adsorbed and integrated to and with the circular ring-shaped magnet 55 by fitting and assembling the central push button 56 in the circular ring-shaped magnet 55.

The operation member 50 is then positioned between the return spring 40 positioned to face each other in the base 30, and the annular rib 54 is fitted and assembled to the fit-in hole 34 of the base 30. Lastly, the caulking hole 62 of the cover plate 60 is fitted and caulking fixed to the caulking projection 31 of the base 30.

The operation method in a case where the input device is assembled in the portable telephone will now be described.

First, when the operation member 50 is slidably moved or rotated, the circular ring-shaped magnet 55 integrated therewith also slidably moves or rotates. Thus, the Hall element 26 detects the change of the magnetic force, and the movement amount, the rotating direction, and the rotation amount of the operation member 50 are detected based thereon.

Such detection result enables the movement of the screen displayed scroll bar of the monitor through the control circuit (not shown) or the monitor screen display up and down or left and right. When the scroll bar reaches the desired position, the central push button 56 is pushed so that the inversion spring in the central push button switch 24 inverts thereby conducting the corresponding central conducting portion and outputting a selection command.

When the operation force is released from the central push button 56, the inversion spring in the central push button switch 24 returns and the operation member 50 automatically returns to the original position by the spring force of the return spring 40.

In the operation member 50 of the present embodiment, the disc plate 58 integrated with the central push button 56 is adsorbed and integrated in a separable manner to and with the circular ring-shaped magnet 55 integrated with the holder 51. Thus, the input device can be thinned and miniaturized, and furthermore, tilt and rattling of the central push button 56 do not occur, and abnormal noise by external vibration etc. does not occur. As such drawbacks do not occur, the configuring parts do not need to be manufactured and assembled at high dimensional accuracy, the productivity is enhanced and the yield is enhanced.

Figure 8A:
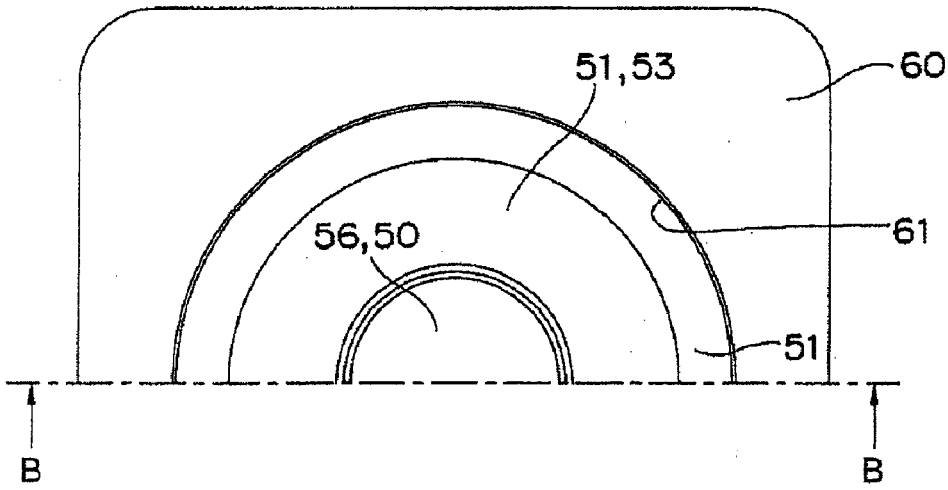
FIGS. 8A to 8C are a partial plan view, a cross-sectional view, and a partially enlarged cross-sectional view showing a second embodiment of the input device.
Figure 8B:
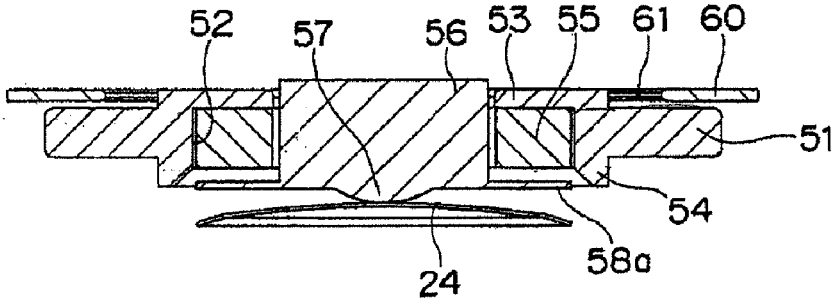
Figure 8C:
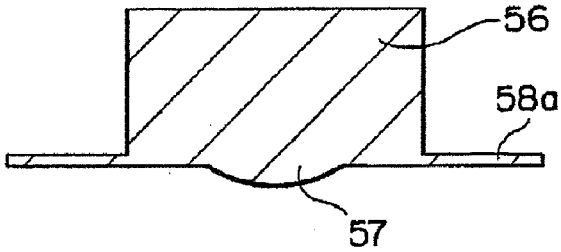

As shown in FIGS. 8A to 8C, the second embodiment is a case where the central push button 56 and a disc plate portion 58*a* are integrally molded with a magnetic material.

According to the present embodiment, the number of parts and the number of assembly steps are reduced, and the productivity is enhanced.

In the first and second embodiments, if the polarity of the disc plate portion 58*a* is made the same polarity as the circular ring-like magnet 55, the central push button 56 can be position-regulated using the repulsive force thereof to thereby prevent tilt and rattling.

Figure 9A:
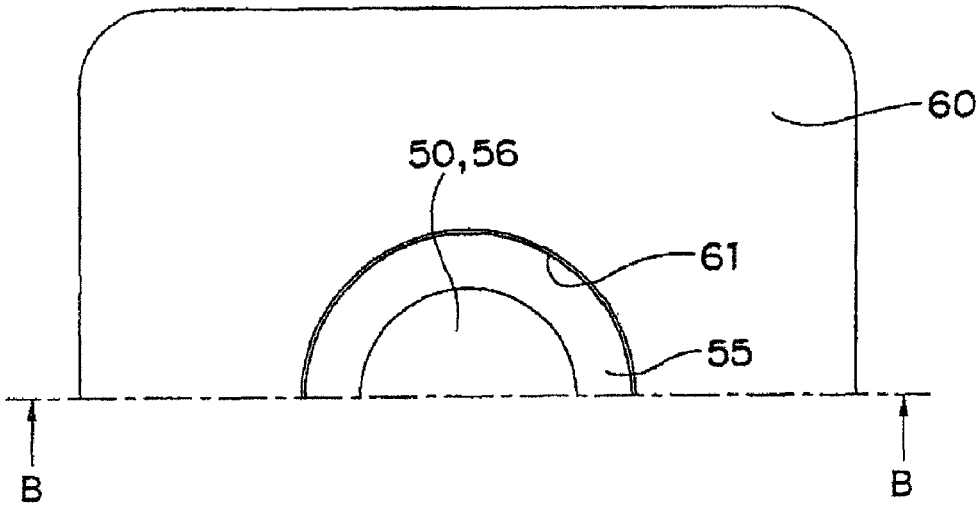
FIGS. 9A to 9C are a partial plan view, a cross-sectional view, and a partially enlarged cross-sectional view showing a third embodiment of the input device.
Figure 9B:
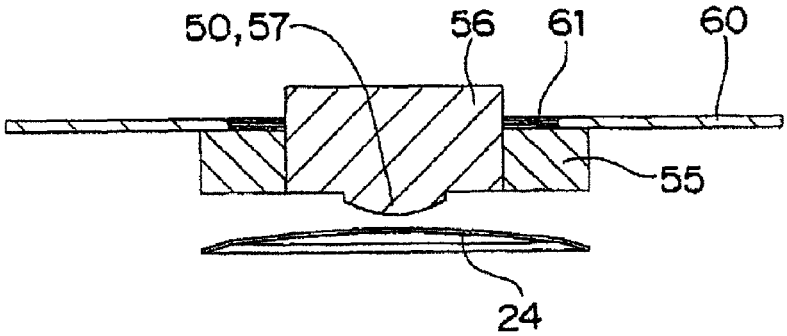
Figure 9C:
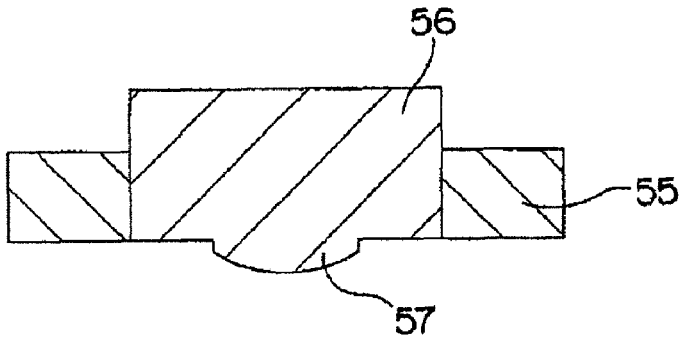

As shown in FIGS. 9A to 9C, the third embodiment is a case where the circular ring-shaped magnet 55 is integrally assembled to the central push button 56, the cover plate 60 is made of magnetic material, and the circular ring-shaped magnet 55 is adsorbed thereto.

According to the present embodiment, the holder is unnecessary, whereby the number of parts and number of assembly steps are reduced, the productivity is enhanced, and the input device can be further thinned and miniaturized.

Figure 10A:
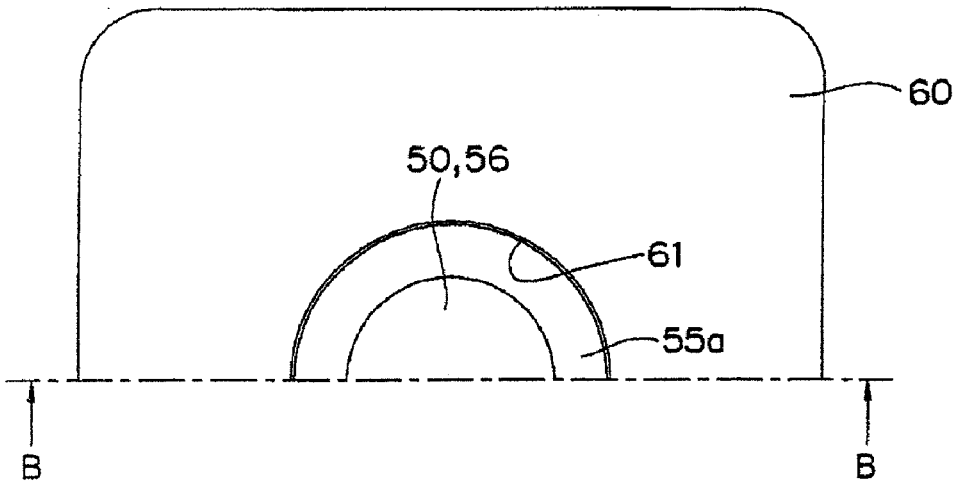
FIGS. 10A to 10C are a partial plan view, a cross-sectional view, and a partially enlarged cross-sectional view showing a fourth embodiment of the input device.
Figure 10B:
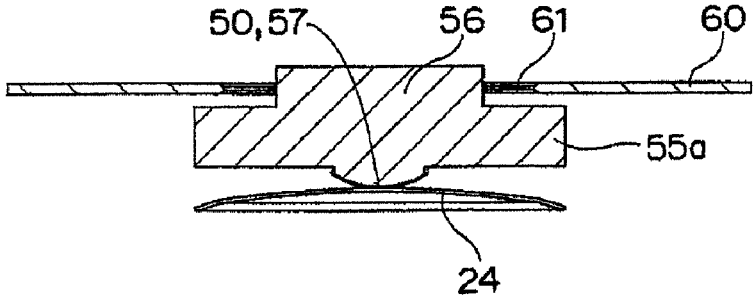
Figure 10C:
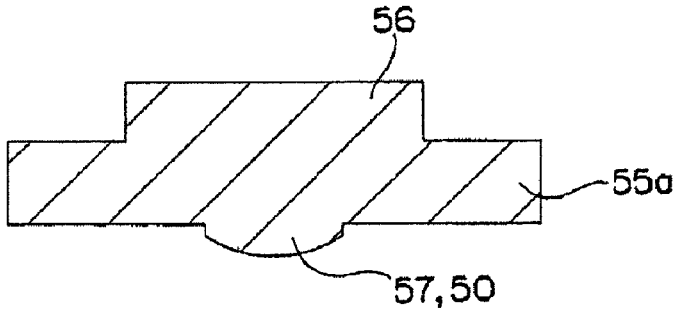

As shown in FIGS. 10A to 10C, the fourth embodiment is a case where the central push button 56 including a magnet and the circular ring-shaped portion 55*a* are integrally molded.

According to the present embodiment, the number of parts and the number of assembly steps are reduced, the productivity is enhanced, and the input device can be further thinned and miniaturized.

In the third and fourth embodiments, if the cover plate 60 and the circular ring-shaped magnet portion 55*a* have the same polarity, the central push button 56 can be position-regulated using the repulsive force thereof.

A case of applying to a portable telephone has been described in the present invention, but may also be applied to other electronic devices such as PC.

What is claimed is:

1. An input device comprising:

a housing comprising an operation hole formed therein;

an operation member supported in a slidably moving manner in multi-directions within the operation hole, and at least two magnetic sensors, arranged at a periphery of the operation member, for detecting change in magnetic property by displacement of the operation member, wherein the operation member includes a holder having a circular ring-shaped magnet incorporated in a fit-in hole and a central push button having a disc plate made of magnetic material integrated at a lower surface, and the central push button is fitted in the circular ring-shaped magnet to adsorb, in a separable manner, the disc plate to the circular ring-shaped magnet and position-regulate the central push button.

2. The input device according to claim 1, wherein the central push button and the disc plate are integrally molded with same magnetic material.

3. An input device comprising:

a housing comprising an operation hole formed therein;

an operation member supported in a slidably moving manner in multi-directions within the operation hole, and at least two magnetic sensors, arranged at a periphery of the operation member, for detecting change in magnetic property by displacement of the operation member, wherein the operation member includes a holder having a circular ring-shaped magnet incorporated in a fit-in hole and a central push button having a disc plate made of magnetic material integrated at a lower surface, the central push button and the disc plate are integrally molded with same magnet material and having same polarity as the circular ring-shaped magnet, and the central push button is fitted in the circular ring-shaped magnet to position-regulate the operation member by a repulsive force of the magnet.

4. An input device comprising:

a cover plate constituting a housing, comprising an operation hole formed therein, an operation member supported in a slidably moving manner in multi-directions within the operation hole, and at least two magnetic sensors, arranged at a periphery of the operation member, for detecting displacement of the operation member with change in magnetic property, wherein the operation member has a circular ring-shaped magnet of a separate body integrally formed at an outer peripheral surface of the central push button, the central push button is operably exposed from the operation hole of the cover plate made of magnetic material, and the circular ring-shaped magnet is adsorbed, in a separable manner, to an inner side of the cover plate.

5. The input device according to claim 4, wherein the central push button of the operation member is integrally molded with a magnet material same as the circular ring-shaped magnet.

6. The input device according to claim 1, wherein a central push button switch is arranged at a portion positioned immediately below the central push button of a print substrate assembled in the housing so as to be positioned on a lower side of the operation member.

7. An electronic device in which the operation member of the input device according to claim 1 is assembled to be operable from outside.

8. The input device according to claim 2, wherein a central push button switch is arranged at a portion positioned immediately below the central push button of a print substrate assembled in the housing so as to be positioned on a lower side of the operation member.

9. The input device according to claim 3, wherein a central push button switch is arranged at a portion positioned immediately below the central push button of a print substrate assembled in the housing so as to be positioned on a lower side of the operation member.

10. The input device according to claim 4, wherein a central push button switch is arranged at a portion positioned immediately below the central push button of a print substrate assembled in the cover plate so as to be positioned on a lower side of the operation member.

11. The input device according to claim 5, wherein a central push button switch is arranged at a portion positioned immediately below the central push button of a print substrate assembled in the cover plate so as to be positioned on a lower side of the operation member.

12. An electronic device in which the operation member of the input device according to claim 2 is assembled to be operable from outside.

13. An electronic device in which the operation member of the input device according to claim 3 is assembled to be operable from outside.

14. An electronic device in which the operation member of the input device according to claim 4 is assembled to be operable from outside.

15. An electronic device in which the operation member of the input device according to claim 5 is assembled to be operable from outside.

16. An electronic device in which the operation member of the input device according to claim 6 is assembled to be operable from outside.

17. An electronic device in which the operation member of the input device according to claim 8 is assembled to be operable from outside.

18. An electronic device in which the operation member of the input device according to claim 9 is assembled to be operable from outside.

19. An electronic device in which the operation member of the input device according to claim 10 is assembled to be operable from outside.

20. An electronic device in which the operation member of the input device according to claim 11 is assembled to be operable from outside.

* * * * *